United States Patent [19]

Wirth et al.

[11] Patent Number: 4,724,805

[45] Date of Patent: Feb. 16, 1988

[54] ENGINE VALVE TRAIN MODULE

[75] Inventors: Rick C. Wirth; Charles M. Philo, both of Jenison, Mich.

[73] Assignee: General Motors Corporation, Detroit, Mich.

[21] Appl. No.: 18,180

[22] Filed: Feb. 24, 1987

[51] Int. Cl.[4] ..... F01L 1/12

[52] U.S. Cl. ..... 123/90.39; 123/90.41; 123/90.44

[58] Field of Search ..... 123/90.39, 90.41, 90.44, 123/90.1

[56] References Cited

U.S. PATENT DOCUMENTS

| | | | |
|---|---|---|---|
| 3,138,146 | 6/1964 | Hutchison | 123/90.39 |
| 3,870,024 | 3/1975 | Ridgeway | 123/90.41 |
| 4,086,887 | 5/1978 | Schoonover et al. | 123/90.39 |
| 4,401,064 | 8/1983 | Nakamura et al. | 123/90.44 |
| 4,488,520 | 12/1984 | Almor | 123/90.39 |
| 4,653,441 | 3/1987 | Belsanti | 123/90.39 |

FOREIGN PATENT DOCUMENTS

| | | | |
|---|---|---|---|
| 165612 | 10/1982 | Japan | 123/90.39 |
| 210307 | 12/1983 | Japan | 123/90.39 |

*Primary Examiner*—Ira S. Lazarus

*Attorney, Agent, or Firm*—Arthur N. Krein

[57] ABSTRACT

A valve train module which can be assembled, tested, shipped and then mounted to the cylinder head of an engine and actuated by a camshaft to effect operation of the intake and exhaust valves for the respective associate cylinders formed in part by the cylinder head includes a rocker positioner used with flanged hex head bolts to support and retain a pair of rocker shafts in a predetermined spaced apart parallel relationship to each other, with each such rocker shaft pivotably supporting associate rocker arm assemblies that are maintained in axial spaced apart relationship to each other by rocker arm positioners on the rocker positioner.

3 Claims, 12 Drawing Figures

ENGINE VALVE TRAIN MODULE

FIELD OF THE INVENTION

This invention relates to an engine valve train and, in particular, to an engine valve train module with rocker positioner used to position rocker arms on rocker shafts so as to effect operation of the intake and exhaust valves for a bank of cylinders in an internal combustion engine.

DESCRIPTION OF THE PRIOR ART

Various arrangements have been used in internal combustion engines of the type having rocker arms pivotably supported on a rocker shaft to effect axial positioning of the rocker arms on the associate rocker shaft. For example, wear pads pressed against the rocker shaft and having two ears thereon or flanged tubular spacers have been used to effect such axial alignment of the rocker arms on the rocker shaft.

However, the desirability to effect a reduction in the cost of manufacturing the valve trains in this type of engine while at the same time effecting an improvement in the reliability of the valve train components has been recognized. One factor which is presently being considered as a means to reduce such costs and to improve reliability is in the increased use of valve train subassemblies which can be directly attached, for example, to the cylinder head of an engine either manually by an assembler or by means of robotic equipment.

SUMMARY OF THE INVENTION

The present invention relates to a valve train module for a bank of cylinders of an internal combustion engine, the valve train module including a rocker positioner which is adapted to locate a pair of spaced apart, hollow rocker shafts, with one of the rocker shafts pivotably supporting the rocker arms used to effect operation of the intake valves and the other rocker shaft pivotably supporting the rocker arms used to effect operation of the exhaust valves for the respective associate cylinders, each of the rocker arms having a roller follower at one end thereof and having a hydraulic lash adjuster operatively positioned in the opposite end thereof and, flanged hex head mounting bolts extending through the rocker positioner and rocker shafts to effect axial positioning of the rocker shafts relative to the rocker positioner, the arrangement being such that the valve train module can be assembled, tested and then shipped as a unit assembly to an engine plant for direct operative attachment to the cylinder head of an engine.

It is therefore a primary object of this invention to provide an improved engine valve train which is adapted to be assembled as a valve train module that can then be tested as a unit assembly and shipped, if necessary, prior to its attachment to the cylinder head for a bank of in-line cylinders of an internal combustion engine.

Another object of this invention is to provide an improved valve train for an engine, the valve train being assembled as a module with a rocker positioner locating a pair of rocker shafts pivotably supporting rocker arms, with integral hydraulic lash adjusters, positioned by the rocker positioner whereby they are operatively located so as to effect operation of associate intake and exhaust valves for the respective cylinders in an in-line bank of cylinders.

For a better understanding of the invention as well as other objects and further features thereof, reference is had to the following detailed description of the invention to be read in connection with the accompanying drawings.

DESCRIPTION OF THE EMBODIMENT OF THE INVENTION

Referring now to the Figures, the preferred and alternate embodiments of the valve train modules with rocker positioners of the invention are shown, for purpose of illustration only, as being for use for a bank of three cylinders in a V-6 internal combustion engine of the type having two inlet ports and one exhaust port per cylinder.

Figure 1:
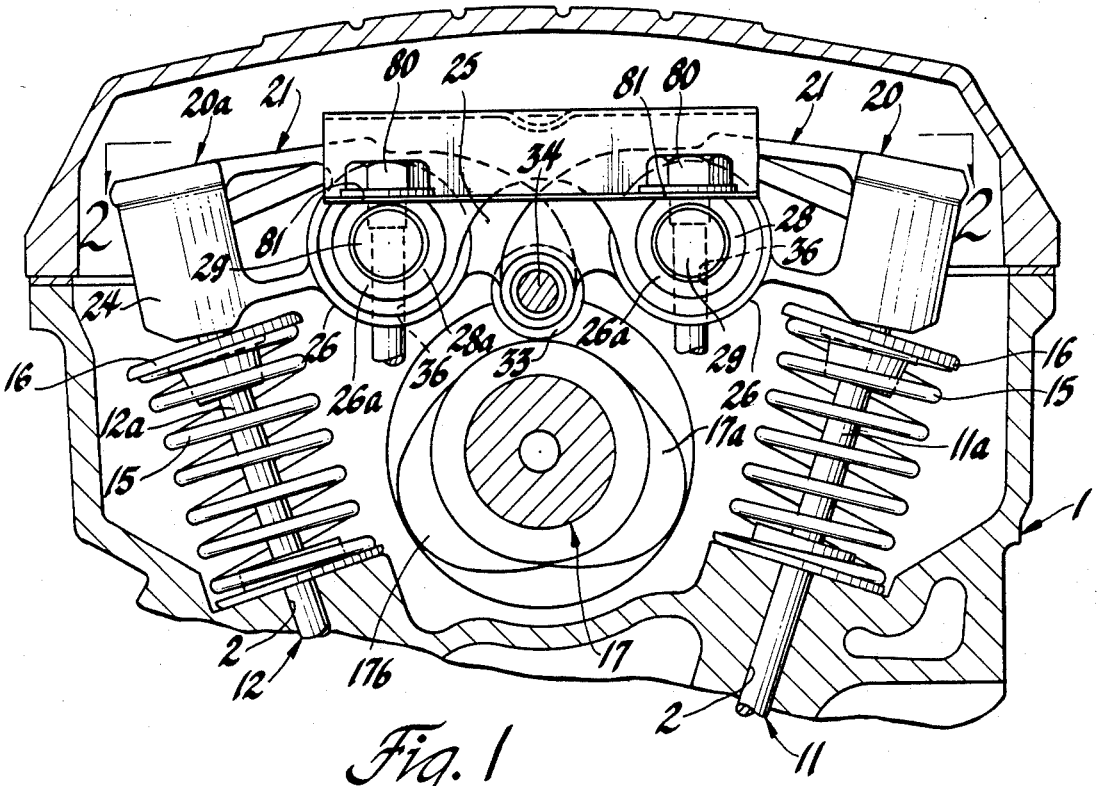
FIG. 1 is a cross-sectional view of a portion of an engine showing the valve train for an in-line bank of cylinders and having a preferred embodiment of a valve train module with rocker positioner in accordance with the invention incorporated therein.
Figure 6:
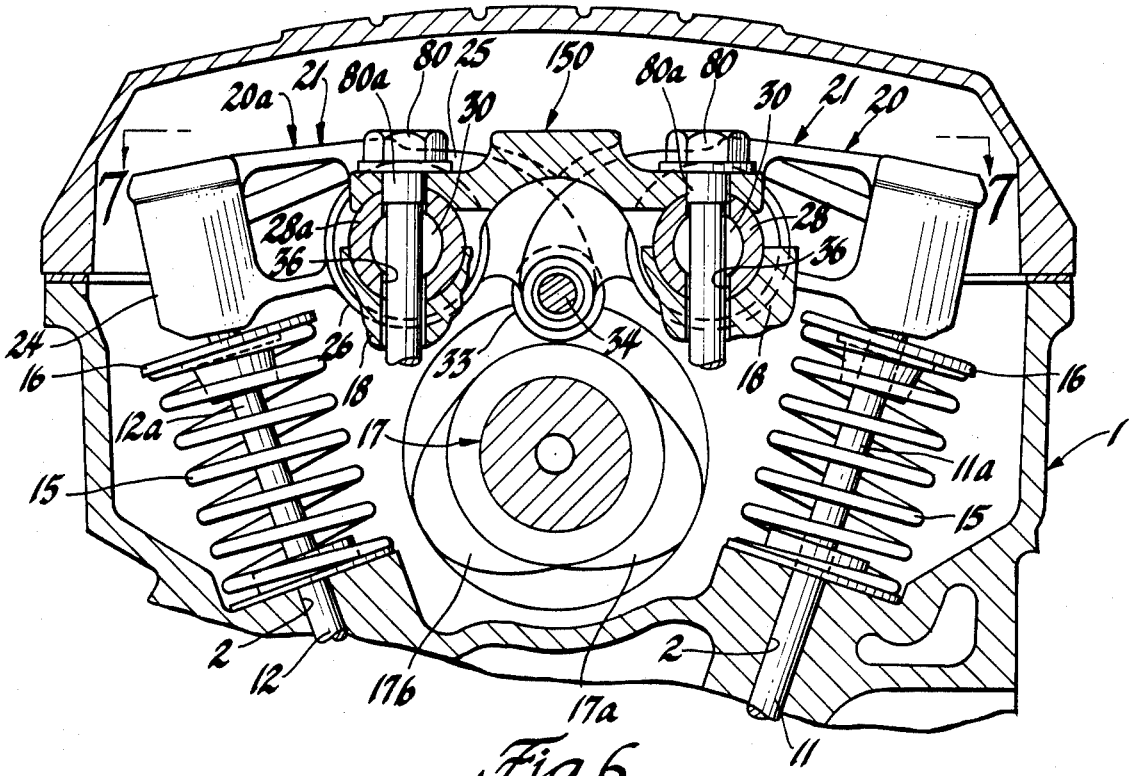
FIG. 6 is a cross-sectional view similar to FIG. 1 but having a valve train module with an alternate embodiment rocker positioner in accordance with the invention incorporated therein.

Referring now to FIGS. 1 and 6, there is shown a portion of such an engine which, as conventional, has an engine block means with two spaced apart rows of in-line cylinders therein defined in part by separate cylinder heads 1, only one of which is shown in these Figures.

A pair of longitudinally spaced apart, poppet type, inlet valves 11 have their respective stems 11*a*, only one of which is shown, reciprocably guided in a suitable valve stem guide bore 2, provided in the cylinder head 10 for movement to open or close an associate inlet port, not shown, in the cylinder head for a respective cylinder, not shown. Laterally spaced from each pair of inlet valves 11 is a poppet type, exhaust valve 12 having its stem 12a reciprocably guided in a similar valve stem guide bore 2 for movement to open or close an associate exhaust port, not shown, in the cylinder head 1 for the associate cylinder, not shown.

As conventional, each of the inlet valves 11 and exhaust valve 12, for each cylinder, are normally biased to a valve closed position by an associate valve return spring 15. One end of such a spring 15 is in abutment against a surface of the cylinder head 1 while its opposite end abuts against a suitable spring retainer 16 fixed in a conventional manner adjacent to but spaced from the upper free end of an associate stem 11a or 12a, for a purpose to be described, of the respective inlet valve 11 or exhaust valve 12.

Figure 3:
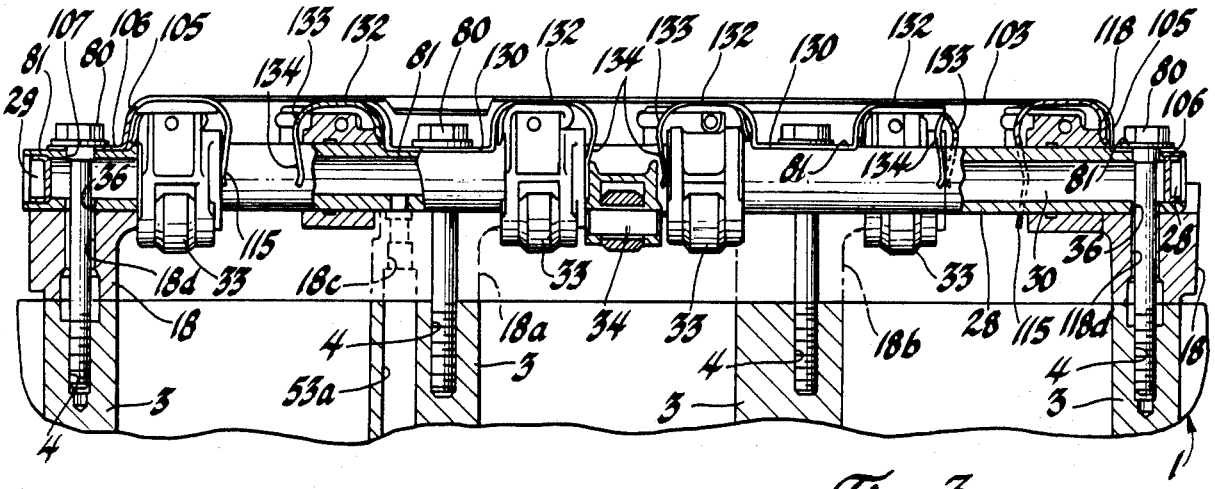
FIG. 3 is a view of the valve train module as taken along line 3—3 of FIG. 2 and showing how the valve train module and the camshaft bearing caps are mounted to the cylinder head of the engine shown in FIG. 1, this view being taken so as not to show the associate camshaft for reasons of clarity relative to the invention, per se.

An engine driven camshaft 17 has at least a plurality of integral journals, not shown, that are axially spaced apart and positioned so as to be rotatably supported in mating, upstanding camshaft bearing pedestals 3 integrally formed as part of the cylinder head 1, as shown in FIG. 3, and associated, suitably apertured, camshaft bearing caps 18, 18a and 18b, each of which is secured as by flanged, hex head bolts 80, to be referred to again hereinafter, which are adapted to be threadingly received in internally threaded stepped bores 4 provided for this purpose in each of the associated pedestals 3, as shown in FIG. 3, with a portion of a conventional end bearing cap 18 being shown in FIG. 6.

The camshaft 17 is also formed with a pair of axial spaced apart inlet cam lobes 17a, only one of which is shown in FIGS. 1 and 6, and an intermediate exhaust cam lobe 17b for each cylinder, with three such sets of cam lobes being provided for the three cylinders, not shown, in a bank of cylinders.

The inlet valves 11 and exhaust valves 12 are suitably operated as by the respective cam lobes 17a and 17b on the camshaft 17 via a respective inlet and exhaust rocker arm assembly with a hydraulic lash adjuster and load/motion control button, generally designated 20, 20a, respectively. Each such rocker arm assembly 20 and 20a is of the type disclosed in copending U.S. patent application Ser. No. 867,145 filed May 27, 1986, now U.S. Pat. No. 4,699,094, in the name of George T. Stegeman and assigned to a common assignee and as such includes a rocker arm 21 having a hydraulic lash adjuster 22 and a load/motion control insert or button, hereinafter referred to as button 23, both to be described in detail hereinafter, operatively supported therein.

Figure 2:
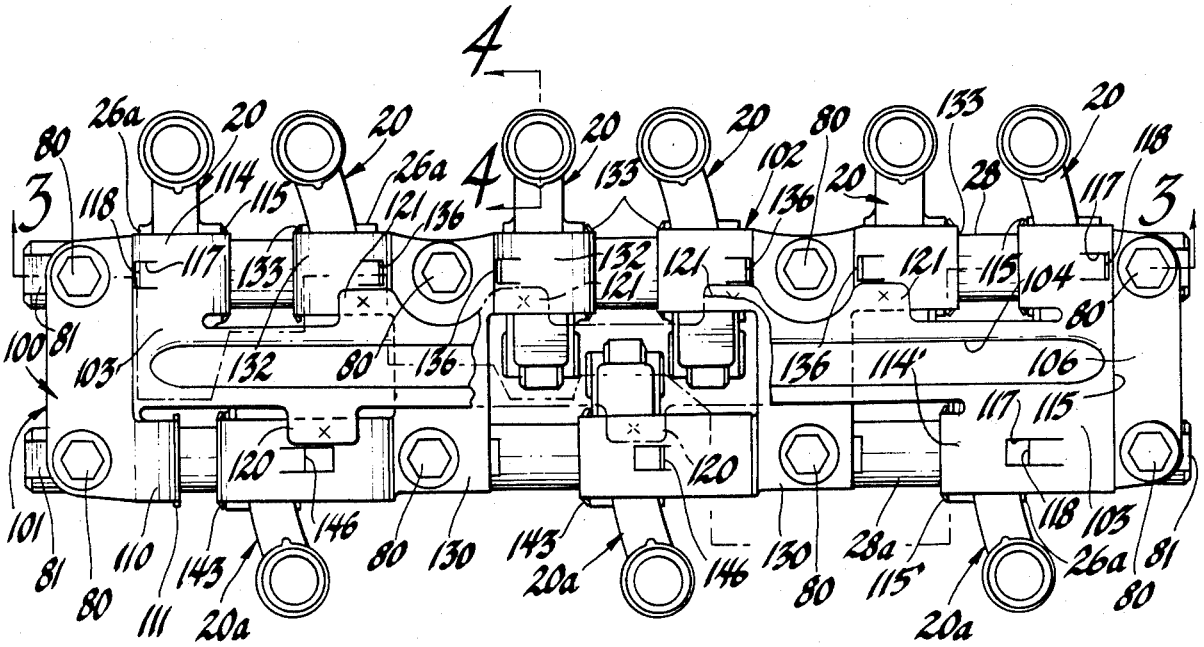
FIG. 2 is a top view of the valve train module, per se, of the valve train of the engine shown in FIG. 1.
Figure 7:
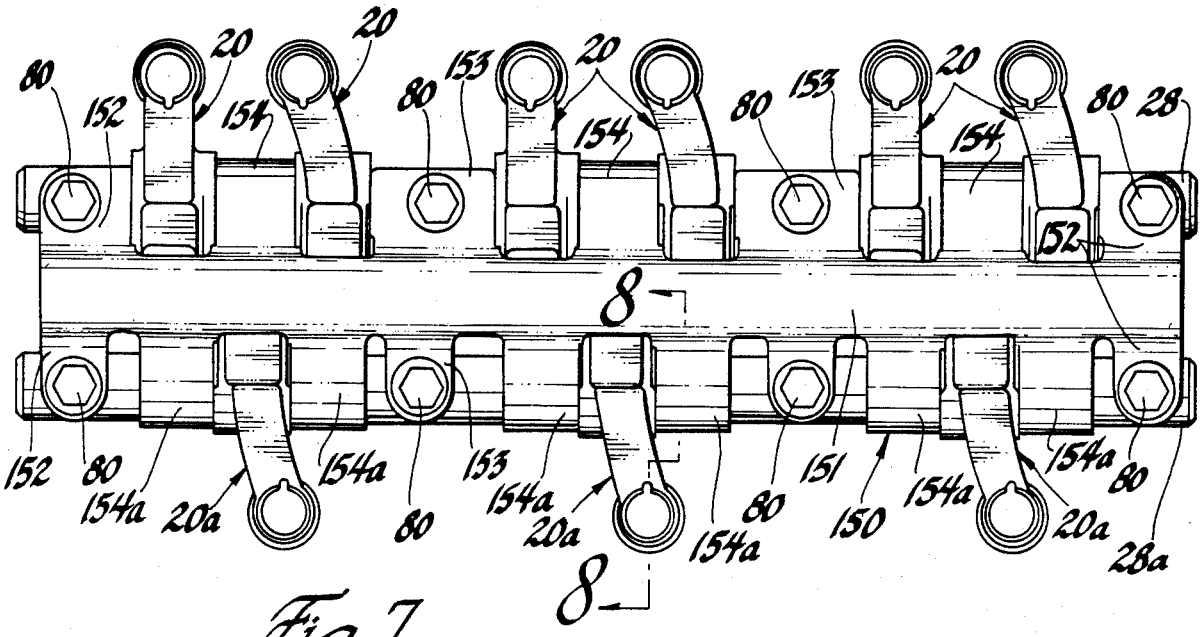
FIG. 7 is a top view of the valve train module, per se, of the engine shown in FIG. 6.

Each of the rocker arms 21 for both the inlet and exhaust rocker arm assemblies 20 and 20a, respectively, although of different configurations as viewed from the top as shown in FIG. 2 and also in FIG. 7, is provided with a valve actuator arm 24 and cam actuated arm 25 overlying the associate stem 11a or 12a of the inlet and exhaust valves 11 or 12, respectively and the cam lobes 17a or 17b, respectively, and with an intermediate support bearing portion 26 having machined opposed side surfaces 26a with a transverse bore 27 extending therethrough. The bore being used to define a sleeve bearing, as shown, to pivotably support this assembly directly or it can be sized to form an outer race for needle bearings, not shown, on a respective fixed hollow inlet rocker shaft 28 or exhaust rocker shaft 28a, as well known in the art.

As is conventional, the inlet rocker shaft 28 is supported above the cylinder head 12 as by the suitably spaced apart camshaft bearing caps 18, 18a and 18b, as shown in FIGS. 3 and 6, whereby it is located parallel to but laterally spaced from the camshaft 17. In a similar manner, the exhaust rocker shaft 28a is supported in laterally spaced apart, parallel relation to the inlet rocker shaft 28 as shown in FIGS. 1 and 6.

Each of the inlet and exhaust rocker shafts 28 and 28a, respectively, is provided with an axial extending bored passage 30, each of which in the construction shown is suitably plugged at opposite ends, as by plugs 29, as shown in FIG. 3. However, each of the passages 30 in the respective rocker shafts 28 and 28a is in continuous communication with the usual pressurized lubricant oil supply of the engine through suitable interconnecting passage means, which for example in the construction shown, are provided by a valve, not shown, controlled passages 18c in the bearing cap 18a and an associate interconnecting passage 53a in the associate pedestal 3, only one set of such passage means being shown in FIG. 3. In addition each such passage 18c is aligned with a respective port 28c provided in each of the rocker shafts 28 and 28a.

In addition, each of the inlet and exhaust rocker shafts 28 and 28a is provided with at least one riser passage 31 for each rocker arm assembly 20 and 20a, respectively, that communicates with an annular groove 32, conventionally provided in either the outer peripheral surface of the rocker shaft 28 or 28a, or, as shown is provided in the inner peripheral surface in the bore 27 of the associate rocker arm 21 of the rocker arm assembly 20, to be described hereinafter. Also as shown, each of the rocker shafts 28 and 28a are provided with axial spaced apart through apertures 36 sized so that the upper aperture 36 portion, as shown for example in FIGS. 1 and 3, will receive the enlarged shoulder portion 80a of the shank of an associated flanged hex head bolt 80.

In the construction illustrated, the cam actuated arm 25 is bifurcated at its free end to define spaced apart roller support arms 25a (FIGS. 2 and 8) so as to loosely receive a cam follower roller 33 suitably rotatably supported on a shaft 34 fixed in and extending through suitable apertures 35 provided for this purpose in the support arms 25a.

Figure 4:
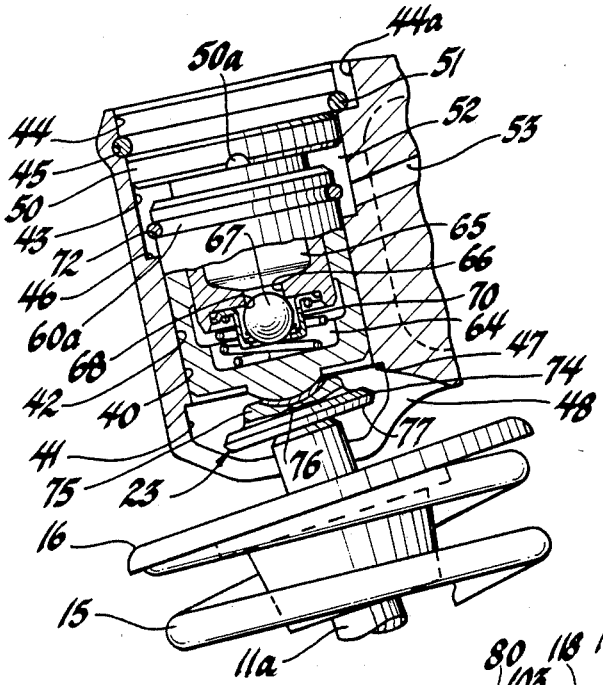
FIG. 4 is a sectional view of a portion of a typical inlet rocker arm assembly with integrally mounted hydraulic lash adjuster and load/motion control button of FIG. 1.
Figure 8:
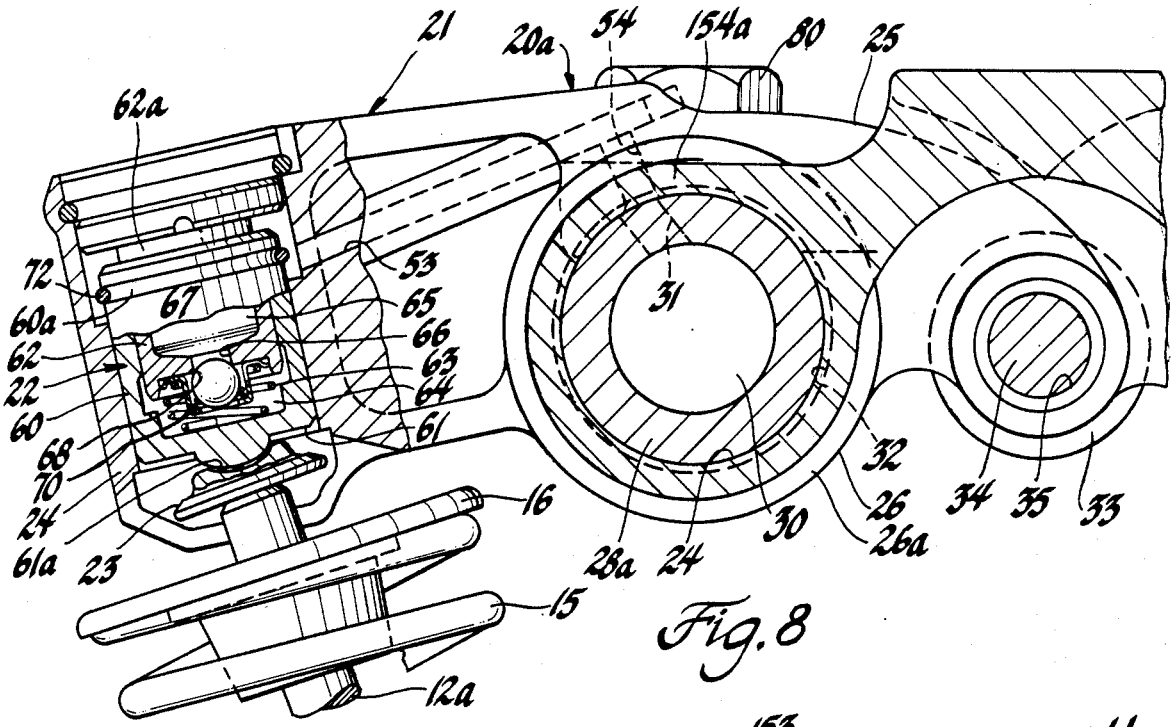
FIG. 8 is an enlarged view of a portion of the valve train shown in FIG. 6, with an exhaust rocker arm assembly, partly in section to show the integrally mounted hydraulic lash adjuster with load/motion control button.

In the embodiment shown and as best seen in FIGS. 4 and 8, each valve actuator arm 24 is provided with a stepped bore 40 in the outer, free end, cylindrical end portion of this arm so as to define in succession, starting from the lower end, a cylindrical lower wall 41, a follower body guide wall 42, an upper intermediate wall 43 and an upper wall 44 having a retainer groove 45 therein so that, in effect, this groove 45 interconnects with the wall 43, this wall 43 being of a smaller internal diameter than that of upper wall 44. The follower body guide wall 42 is of a internal diameter less than that of adjacent wall 43 and 41 and is connected to wall 43 by a flat shoulder 46 and is connected to wall 41 by a shoulder 47. In addition and as best seen in these Figures, the lower free end portion of each valve actuator arm 24 is provided, for example, with a longitudinal slot 48 formed at right angles to the pivotal axis of the rocker arm 21, which slot breaks through the lower wall 41 and is formed of a suitable width so as to loosely receive the upper free end of the stem 11a or 12a of an associate intake or exhaust valves 11 or 12, respectively.

As shown in FIGS. 4 and 8, one end or upper end of the bore 40 is closed by means of a disc retainer 50 that is positioned in the upper intermediate wall 43 and retained against axial movement in one direction, upward with reference to these Figures, by means of a split ring retainer 51 operatively positioned in the retainer groove 45. Also as seen in these Figures and also in FIGS. 2 and 7 the upper wall is also provided with a vertical groove 44a of a suitable width to receive a tool, such as a screwdriver, not shown, to permit removal of the split ring retainer 51 if desired.

The lower surface of the disc retainer 50, which is provided with at least one radial cross groove 50a therein, forms with the upper intermediate wall 43, a fluid reservoir 52 which is in flow communication via a bored passage 53 which extends from the wall 43 through the valve actuator arm 24 and into the support portion 26 so as to intersect a riser bore 54 in the support portion 26 that opens at its lower end through the bore 27 wall whereby it is always in fluid communication with the groove 32 and with the bored passage 30 in an associate inlet or exhaust rocker shaft 28 or 28a, respectively.

The hydraulic lash adjuster 22, as best seen in FIGS. 4 and 8, except for the specific configuration of the closed end of the follower body thereof, is of conventional construction and includes a cup-shaped, follower body 60, having a closed end 61, that is slidably received in the follower guide wall 42. A plunger or piston 62 has a close sliding fit for reciprocation within the follower body 60 and is normally biased upwardly therein by a plunger spring 63 so that the upper end 62a of the plunger 62 abuts against the lower surface of the disc retainer 50, as seen in FIGS. 4 and 8. The plunger spring 63 also acts against the closed end 61 of the follower body 60 so as to maintain the actuator 61a, to be described, on its closed end 61 in operative engagement with the control button 23, which in turn is thus maintained in abutment against the upper free end surface of the associate stem 11a or 12a of the associate inlet or exhaust valves 11, 12, respectively, as shown in FIGS. 4 and 8.

The lower end of the plunger 62 forms with the closed end of the follower body 60 a pressure chamber 64 while the upper open end of the plunger 62 defines a supply chamber 65 that is in continuous flow communication with the fluid reservoir 52 in the embodiment illustrated. The supply chamber 65 is in flow communication with the pressure chamber 64 via an axial port 66, flow through which is controlled by a one-way valve in the form of a ball 67 which closes against a seat 68 of the plunger that encircles port 66.

A suitable valve cage 70 and valve return spring 71 limits open travel of the valve ball 67 to the amount necessary to accommodate replenishment of the pressure chamber 64 with oil which normally escapes therefrom between the sliding surfaces of the plunger 62 and follower body 60 as "leak-down" during cam induced opening movements of, for example the stem 10a of the poppet inlet valve 10. As shown, the valve cage 70 is held in position against the plunger 62 by the plunger spring 63, or alternatively, the valve cage 70 could be held as by a press fit to the plunger 62.

In addition, the hydraulic lash adjuster 22 is also axially retained for limited movement in one direction within the rocker arm 21 by means of a retainer ring 72 operatively positioned in an annular groove 60a provided for this purpose in the outer peripheral surface of the follower body 60, whereby the retainer ring 72 can come into abutment against the shoulder 46 to thereby limit downward travel, with reference to FIGS. 4 and 8, of the follower body 60 a predetermined axial extent such that the button 23 is loosely trapped within the rocker arm 21 in a manner whereby this button 23 cannot tilt enough so that it could possibly fall out through the slot or hole 48, as during shipment of this rocker arm assembly to an engine plant.

In the embodiment shown in FIGS. 4 and 8, the actuator 61a is of semi-spherical configuration with a predetermined radius $R_2$, determined in a manner described in detail in the above-referenced U.S. patent application Ser. No. 867,145, now U.S. Pat. No. 4,699,094. Accordingly, with an actuator 61a of semi-spherical configuration, the button 23, as best seen in these Figures is in the form of a circular disc 74 having a central raised boss portion 75 with an actuator receiving socket 76 therein that, for example, is also of semi-spherical configuration of a suitable radius $R_m$ that is a predetermined amount greater than the radius $R_2$ of the actuator 61a. As shown, the circular disc 74 is provided with a flat bottom surface 77 for abutment against the upper flat free end surface of the associate stem 11a and 12a of the associate inlet or exhaust valve 11 or 12, respectively. Also as best seen in FIGS. 4 and 8, the outside diameter and thickness of the button 23 is preselected so that this button 23 can articulate around the actuator 61a within the cavity defined by the lower wall 41 in the valve actuator arm.

Preferably, at least the surface defining the socket 76 is provided with a suitable lubricant, such as a coating of tin, whereby to provide for lubrication between it and the actuator 61a during initial engine start up, after which these elements will be lubricated by oil leakage from between the guide wall 42 and the outer peripheral surface of the follower body 60 or, by splash lubrication in a manner well known in the art.

For a more detailed description of the rocker arm assemblies 20, reference is made to copending patent application Ser. No. 867,145 entitled "Rocker Arm and Hydraulic Lash Adjuster with Load/Motion Control Button" filed May 27, 1986, the disclosure of which is incorporated herein by reference thereto.

Now in accordance with a feature of the invention, a rocker positioner, generally designated 100, is operatively used, together with the flanged hex-head bolts 80, to support and axially retain the rocker shafts 28 and 28a together with the rocker arm assemblies 20, 20a mounted on the respective rocker shafts 28 and 28a in unit assembly as a valve train module with the rocker positioner 100 serving to axially locate and retain each of the rocker arm assemblies in a predetermined operative position while at the same time limiting pivotal movement of the respective rocker arms whereby their angular positions are such that the valve train module with rocker positioner 100 can be assembled to an associate cylinder head 10 without an assembler being required to pivot the rocker arms to a position corresponding substantially to their position shown in, for example, FIG. 1.

Referring now to the preferred embodiment of the rocker positioner 100 shown in FIGS. 1–5, it is made of spring sheet metal and although it could be fabricated as a single sheet metal stamping, for ease in manufacturing and in the construction and for the application shown it is formed as multi-piece metal stampings which includes an elongated base 101 and a pair of identical rocker retainers 102 which are suitably secured, as by welding at x to the base 101 in spaced apart relationship to each other as best seen in FIG. 2.

Figure 5:
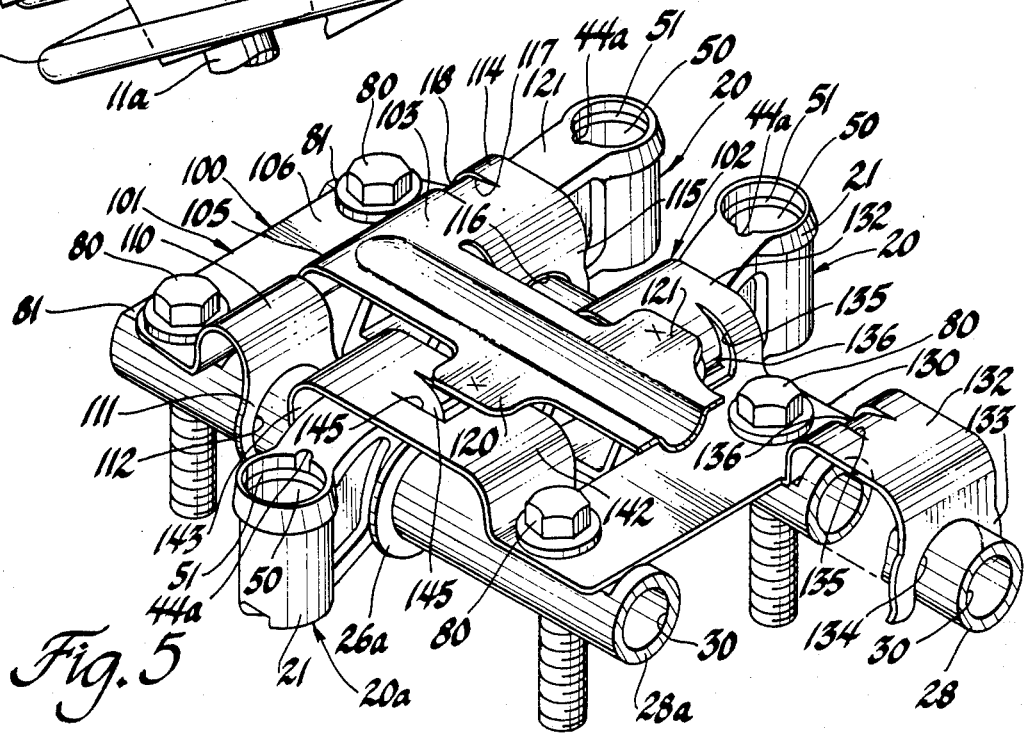
FIG. 5 is a perspective view of a portion of the valve train module with rocker positioner in accordance with the preferred embodiment of FIGS. 1–3.

The base 101, as best seen in FIGS. 2, 3 and 5, includes a center support portion 103 having a reinforcing rib 104 stamped therein intermediate its outboard ends which each terminates in an L-shaped portion that includes a depending leg 105 and an outboard extending rocker shaft hold-down flange or cross piece 106 having spaced apertures 107 of a size to receive the shank of a flanged hex-headed bolt 80 with the axis of the apertures being located for alignment with a respective outboard end aperture in each of the rocker shafts 28 or 28a and, accordingly, with the respective aperture 18d in an associate camshaft bearing cap 18 and an internally threaded bore 4 in an outboard end camshaft bearing pedestal 3, as shown in FIGS. 1 and 3.

At the left end of the base 101, with reference to FIGS. 2 and 5, and formed integral therewith and the respective leg 105 there is provided on one side thereof a short longitudinal side extension support 110 terminating in a depending bent shaft support arm 111 having a suitable configured through aperture 112 so as to receive and support a rocker shaft 28a extending therethrough and at its opposite side there is provided an elongated longitudinal side extension support 114 that also terminates in a similar depending bent shaft support arm 115 that has a suitably configured through aperture 116 to also receive and support a rocker shaft 28 extending therethrough in the manner best seen in FIG. 5. In addition, the lateral side extension support 114 is pierced as at 117 whereby to provide for a downward bent depending rocker guide arm 118 as best seen in the left hand side of FIG. 3 and in FIG. 5.

At the right hand end of the base 101, with reference to FIG. 2, there is formed integral with the associate leg 105 on one side thereof an elongated longitudinal side extension support 114 that terminates in a depending bent shaft support arm 115 with an aperture 116 to receive the rocker shaft 28. This support 114 is also pierced as at 117 whereby to provide for a downward bent depending rocker guide arm 118.

This leg 105 on its opposite side also has formed integral therewith a second elongated longitudinal side extension support 114' that terminates in a depending bent shaft support arm 115' with an aperture, not shown, to receive the rocker shaft 28a. This support 114' is also pierced as at 117' whereby to provide for a downward bent rocker guide arm 118'.

As best seen in FIG. 2, the supports 110, 114 and 114' are provided on opposite sides of the support portion 101 so as to cooperate with an associate inlet rocker arm assembly 20 and exhaust rocker arm assembly 20a, respectively, at the right hand of the rocker positioner 100 with reference to FIG. 2 while at the opposite or left hand end, the supports 110 and 114 are located such that the support 114 is positioned to cooperate with an associate inlet rocker arm assembly 20 only in this construction as shown in FIGS. 2 and 5.

In addition, as shown in these Figures, each of the rocker guide arms 118 are longitudinally spaced so as to cooperate with an associate rocker shaft support arm 115 or 115' whereby to longitudinally position an associate rocker arm assembly 20 or 20a on its respective associate rocker shaft 28 or 28a. As will now be apparent, the lateral side extension supports 110 and 114 that are associated with a rocker arm assembly 20 or 20a will operate to limit its pivotal movement in one direction, that is, with reference to FIG. 1, pivotal movement of an associate inlet rocker arm assembly 20 in a clockwise direction and of an exhaust rocker arm assembly 20a in a counterclockwise direction, prior to the assembly thereof to an associate cylinder head 1.

Referring again to FIG. 2, the center support portion 103 has also formed integrally therewith a pair of laterally outward extending support tabs 120 on one side thereof and on its opposite side it is provided with two sets of additional laterally outward extending support tabs 121.

Referring now to the rocker retainers 102, each such rocker retainer 102 is formed with a lateral rocker shaft hold-down flat flange or cross piece 130 having spaced apart apertures 131 each located so as to receive the shank of a flanged, hex-head bolt 80, the shank then extending through the respective associate aperture in a rocker shaft 28 or 28a whereby the rocker retainer is axially located on these rocker shafts. The cross piece 130, at the end thereof associated with the rocker shaft 28, as best seen in FIGS. 2 and 3 and in part in FIG. 5, has opposite sides thereof formed with integral upward extending return bent portions 132 each terminating at its free end in a depending rocker guide arm 133 having a semi-circular groove 134 to receive and in part loosely encircle the upper portion of the rocker shaft 28. This groove 134, in effect dividing the rocker guide arm 133 into a pair of spaced apart spring fingers. In addition each such return bent portion 132 also has its surface pierced as at 135 to provide for a depending rocker guide arm 136 which cooperates with the rocker guide arm 133 to operatively position an associate rocker arm assembly 20.

Since in the construction shown both the flanges or cross pieces 106 and 130 are flat, the inlet and exhaust rocker shafts 28 and 28a, respectively, are suitably machined at predetermined axial spaced apart locations to provide flat support surfaces 81 of a suitable axial extent so as to receive the flanges or cross pieces 106 and 130, as best seen in FIGS. 3 and 5 whereby these elements, in effect, define a part of a rocker shaft retainer means.

The cross piece 130 at its opposite end, that is the end associated with the rocker shaft 28a has one side thereof, the left hand side with reference to FIGS. 2 and 5, also formed with an integral upstanding return bent portion 142 terminating at its free end in a depending rocker guide arm 143 also provided with a semi-circular groove, not shown, to receive and in part loosely encircle the upper portion of the rocker shaft 28a, this groove, in effect dividing the rocker guide arm into a pair of spaced apart spring fingers. This return bent portion 142 also has its surface pierced as at 145 to provide for a depending rocker guide arm 146 located relative to rocker guide arm 143 whereby a rocker arm assembly 20a can be operatively positioned therebetween on the rocker shaft 28a.

As should now be apparent, the rocker guide arms 118 and supports 115 or 115'; the rocker guide arms 133 and 136; and, the rocker guide arms 143 and 146, operative in sets as spring fingers and are spaced in such sets so as to have their spring fingers biased into engagement against opposed side surfaces 26a of an associate rocker arm assembly 20 or 20a, as described, whereby to maintain the desired axial position of these rocker arm assemblies on the respective rocker shafts 28 and 28a, as shown in FIG. 2.

It should now be apparent and as shown in FIG. 2, each of the return bent portions 132 and 142 of the rocker retainers 102 are formed of a suitable height relative to its cross piece 130 so that they can be welded to support tabs 120 and 121, respectively.

A valve train module with an alternate embodiment rocker positioner, generally designated 150, in accordance with the invention is shown in FIGS. 6 through 12, inclusive, wherein similar parts are designated by similar numerals.

As shown in FIGS. 6 and 7, the valve train module with rocker positioner 150 is shown for purpose of illustration only as being for use on a bank of three cylinders in a V-6 internal combustion engine of the type having two inlet ports and one exhaust port per cylinder, not shown.

Thus as shown in FIG. 7, the rocker shaft 28 pivotably supports three sets of two inlet rocker arm assemblies 20 while the rocker shaft **28*a* pivotably supports the three individual exhaust rocker arm assemblies 20*a*** for the three cylinders, not shown.

In this alternate embodiment, the rocker positioner 150 is in the form of a one-piece casting, preferably of an aluminum alloy 384 for die or investment casting.

Figure 9:
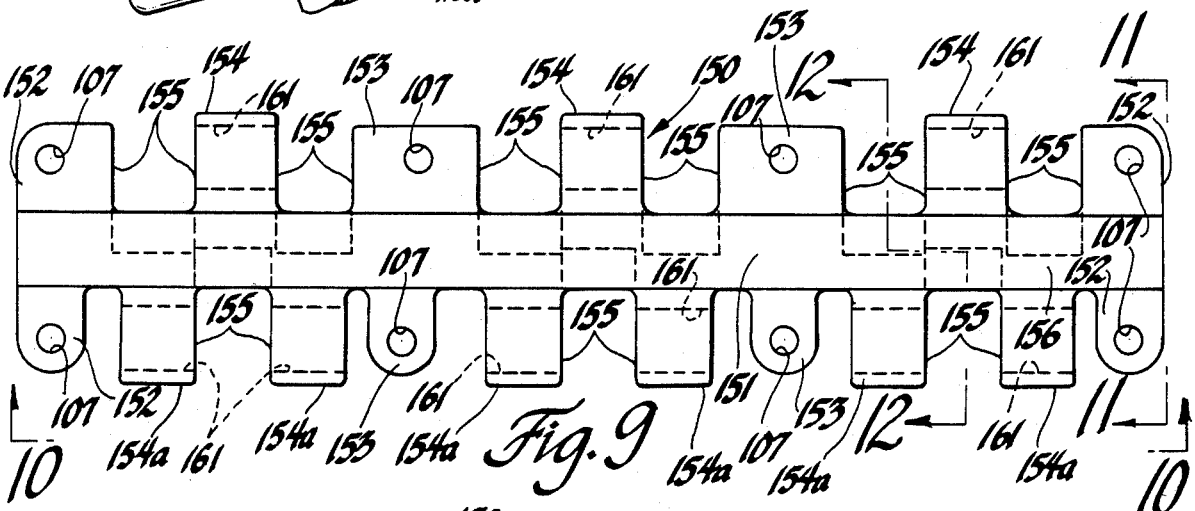
FIG. 9 is a top view of the alternate embodiment rocker positioner, per se.

As best seen in FIGS. 7 and 9, the rocker positioner 150 includes a longitudinal extending central base or support portion 151, which at opposite ends thereof is provided with integral rocker shaft hold-down cross pieces 152 and, intermediate its ends is provided with spaced apart integral rocker shaft hold-down cross pieces 153. As shown in these Figures, each of the rocker shaft hold-down cross pieces 152 and 153 are provided with through apertures 107 that are laterally and longitudinally spaced apart so that each such aperture 107 is adapted to receive the shouldered shank of an associate flanged hex head bolt 80 for alignment with a respective one of the through apertures 36 that are suitably axially positioned, as desired, in spaced apart relationship on the rocker shafts 28 and **28*a***.

Extending laterally outward and downward from one side of the support portion 151, the upper side with reference to FIGS. 7 and 8, are three rocker shaft guide arms 154, two of which are located intermediate respective cross pieces 152 and 153 and the other being located between the cross pieces 153.

Opposed surfaces of the guide arms 154 and the respective cross pieces 152 and 153 are machined so as to define rocker guide arm surfaces 155, as shown in FIG. 9, that are suitably spaced apart so as to slidably receive between such opposed surfaces 155 the machined opposed side surfaces **26*a* of a rocker arm 21 of an associate inlet rocker arm assembly 20 as shown in FIG. 7**.

Extending laterally outward and downward from the opposite side of the support portion 151 are three sets of spaced apart guide arms **154*a* each such set of guide arms 154*a* having their opposed surfaces machined to define rocker guide arm surfaces 155 so as to slidably receive therebetween the opposed side surfaces 26*a* of a rocker arm 21 of an associate exhaust rocker arm assembly 20*a***.

In addition and as best seen in FIGS. 6, 8, 9 and 12, the lower opposed sides of the support portion 151 between each opposed set of rocker guide arm surfaces 155 is provided with a coterminous arcuate groove 156 sized so as to permit normal pivotal movement of an associate rocker arm assembly 20 or **20*a***, while preventing excessive pivotal movement of such rocker arm assemblies during handling of the valve train module.

Figure 11:
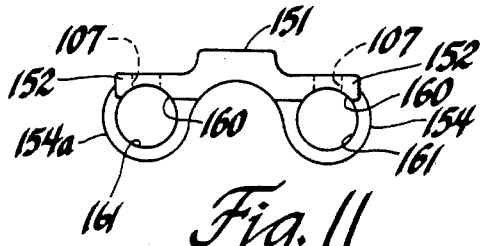
FIG. 11 is an end view of the rocker positioner of FIG. 9 taken along line 11—11 of FIG. 9; and, FIG. 12 is a cross-sectional view of the rocker positioner of FIG. 9 taken along line 12—12 of FIG. 9.
Figure 12:
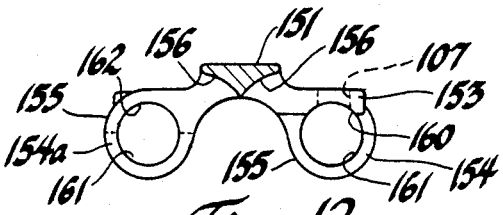

In the construction shown and as best seen in FIGS. 11 and 12, the rocker shaft hold-down cross piece 152 and 153, instead of having flat bottom surfaces as in the rocker positioner 100 of the embodiment shown in FIGS. 1–5, are provided with spaced apart semi-circular grooves 160 formed complementary to the outer peripheral surfaces of the rocker shafts 28 and **28*a*. With this arrangement, there is no requirement to provide machined flats on the rocker shafts 28 and 28*a* as required with the rocker positioner 100**.

Figure 10:
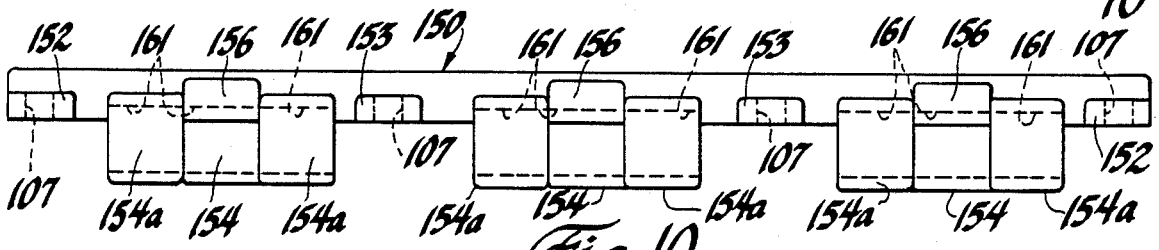
FIG. 10 is a side view of the rocker positioner, per se, of FIG. 9.

In addition, in the construction shown and as best seen in FIGS. 8–10, each of the rocker shaft guide arms 154 and **154*a* is provided with a through aperture 161 of a suitable internal diameter so as to slidably receive an associate rocker shaft 28, 28*a*, respectively, and thus can be used to support these rocker shafts and of course the rocker arm assemblies supported thereon in unit assembly with the rocker positioner 150**.

However, preferably the lower half of the rocker shaft guide arms 154 and **154*a* can be eliminated as shown by the broken line in the left hand end of FIG. 12, so as to substantially reduce the overall weight of the rocker positioner 150 while still having an arcuate portion 162 to hold the rocker shafts 28 and 28*a* in parallel alignment. Alternately, depending on a specific engine application or a desire to physically support the rocker shafts by the rocker positioner 150, it should also be realized that one or more of the rocker shaft guide arms 154 and 154*a* can be provided with the apertures 161 for supporting the associate rocker shafts 28 and 28*a*, while the remainder of the rocker shaft guide arms 154 and 154*a*** can have their lower half removed, as described hereinabove.

From the above descriptions of the rocker positioners 100 and 150, it should now be apparent that by the use of a suitable assembly jig, not shown, used to support such a rocker positioner in an elevated position, the rocker shaft 28 with the inlet rocker arm assemblies 20 thereon can be mounted to the associate rocker positioner 100 or 150 and the rocker shaft axially positioned by the flanged hex head bolts 80, which can be inserted through the rocker positioner and rocker shafts because of the elevated location of the rocker positioner. Of course the individual inlet rocker arm assemblies 20 will be correctly axially spaced in the desired operating position on this rocker shaft 28.

In a similar manner, the rocker shaft 28 with the exhaust rocker arm assemblies 20 thereon will be operatively mounted to the associate rocker positioner 100 or 150, thus completing the assembly of the valve train module. This valve train module can then be tested prior to its shipment to an engine plant for assembly to the cylinder head of an engine.

In moving the disclosed type valve train module, it is preferably picked up by gripping the opposite ends of the rocker shafts 28 and **28*a***.

For shipment, the subject valve train can be supported on a suitable pallet, not shown, which would include a substantially rectangular base having a transverse upstanding pedestal fixed adjacent to opposite ends of the base, with each such pedestal having suitably spaced apart V-shaped grooves therein in which the rocker shaft would be supported.

Such a pallet has not been shown or described in detail herein since it is not part of the subject invention but such a pallet can be constructed in a manner similar to the shipping pallet shown: in copending U.S. patent application Ser. No. 07/018,179 filed 2/24/87, entitled "Valve Train Module with Rocker Positioner", filed concurrently in the name of Rick C. Wirth and assigned to a common assignee.

While the invention has been described with reference to the structures disclosed herein, it is not confined to the specific details set forth, since it is apparent that many modifications and changes can be made by those skilled in the art. This application is therefore intended to cover such modifications or changes as may come within the purposes of the improvements or scope of the following claims.

The embodiments of the invention in which an exclusive property or privilege is claimed are defined as follows:

1. A valve train with rocker positioner that is adapted to be assembled as a valve train module, tested, shipped and then mounted to the cylinder head of an internal combustion engine in position to effect operation of the inlet and exhaust valves associated with the cylinder head via rocker arm assemblies pivotably supported on a first rocker shaft having axially spaced apart mounting apertures therethrough and the rocker arm assemblies pivotably supported on a second rocker shaft having axially spaced apart mounting apertures therethrough, said rocker arm assemblies being adapted to be actuated by an engine driven camshaft of the engine, said rocker positioner including shaft retainer means to effect retention of said first rocker shaft and said second rocker shaft in spaced apart parallel alignment with respect to each other; rocker positioning means to effect and retain a predetermined axial operative position of said rocker arm assemblies on a respective associate said first rocker shaft and said second rocker shaft; anti-rotation means to maintain the angular position of said rocker arm assemblies at a position corresponding substantially to the operative position of each of said rocker arm assemblies as installed on the cylinder head of an engine; and, fastener means operatively associated with said rocker positioner and said first and second rocker shafts to retain said elements together as a valve train module and then to effect attachment of said rocker positioner and said first and second rocker shafts to the cylinder head of an engine whereby said valve train module will be secured in position to effect operation of said inlet and exhaust valves.

2. A valve train with rocker positioner according to claim 1 wherein said rocker positioner is in the form of a stamped sheet metal rocker positioner wherein said shaft retainer means includes spaced apart lateral rocker shaft hold-down cross pieces each having spaced apart apertures to receive said fastener means for alignment with the associate mounting apertures in said first and second rocker shafts and depending sets of apertured shaft supports for supporting a respective one of said first and second rocker shafts and wherein said rocker positioner means are defined by sets of spaced apart spring rocker guide arms having surfaces for engaging opposite sides of an associate said rocker arm assemblies on each of said first and second rocker shafts.

3. A valve train with rocker positioner according to claim 1 wherein said rocker positioner is in the form of cast one-piece rocker positioner wherein said shaft retainer means includes a pair of spaced apart outboard rocker shaft hold-down cross pieces and a pair of spaced apart intermediate rocker shaft hold-down pieces which include depending rocker guide arms each having an aperture extending therethrough to slidably receive an associate one of said first and second rocker shaft and, wherein said rocker positioner means includes opposed sets of rocker guide arm surfaces suitably spaced so as to slidably receive an associate one of said rocker arm assemblies therebetween.

* * * * *